US006964607B2

(12) United States Patent
Sasaki

(10) Patent No.: US 6,964,607 B2
(45) Date of Patent: Nov. 15, 2005

(54) GAME SYSTEM AND GAME METHOD

(75) Inventor: Satoshi Sasaki, Tokyo (JP)

(73) Assignee: Namco Ltd., Tokyo (JP)

( * ) Notice: Subject to any disclaimer, the term of this patent is extended or adjusted under 35 U.S.C. 154(b) by 140 days.

(21) Appl. No.: 09/959,762

(22) PCT Filed: Mar. 7, 2001

(86) PCT No.: PCT/JP01/01761

§ 371 (c)(1),
(2), (4) Date: Nov. 16, 2001

(65) Prior Publication Data

US 2002/0160839 A1 Oct. 31, 2002

(30) Foreign Application Priority Data

Mar. 10, 2000 (JP) ..... 2000-066143

(51) Int. Cl.[7] ..... A63F 9/22
(52) U.S. Cl. ..... 463/2; 463/51
(58) Field of Search ..... 463/2, 7, 51–52, 463/20

(56) References Cited

U.S. PATENT DOCUMENTS 4,799,687 A * 1/1989 Davis et al. ..... 463/5
5,213,335 A * 5/1993 Dote et al. ..... 463/51
5,401,025 A * 3/1995 Smith et al. ..... 463/5
6,012,980 A * 1/2000 Yoshida et al. ..... 463/2
6,323,838 B1 * 11/2001 Thanasack et al. ..... 345/156
6,328,650 B1 * 12/2001 Fukawa et al. ..... 463/36
6,458,034 B1 * 10/2002 Aiki et al. ..... 463/49
6,556,204 B1 * 4/2003 Itai et al. ..... 345/472

FOREIGN PATENT DOCUMENTS

| | | |
|---|---|---|
| JP | A 49-98098 | 9/1974 |
| JP | A 3-134499 | 6/1991 |
| JP | A 9-47577 | 2/1997 |
| JP | A 11-259687 | 9/1999 |

OTHER PUBLICATIONS

Toru Hidaka, "Popcom Books PC–8801 Series; Machin–go Game Graphics",1st printing, May 1990, pp. 2, 72–76, 82–85.

* cited by examiner

*Primary Examiner*—Derris H. Banks
*Assistant Examiner*—Corbett Coburn
(74) *Attorney, Agent, or Firm*—Oliff & Berridge, PLC

(57) ABSTRACT

There is provided a game system which can change the configuration of an image based on the detected illuminating position of a light illuminating device to improve the effect of a game. The game system includes a light detection section which detects a position of a spotlight on a screen formed by an infrared light emitting section, an area setting section which sets a given specified area based on the position of the spotlight detected by the position detection section, and an image effect section which displays an image so that the specified area is displayed in a manner different from that of an area other than the specified area.

28 Claims, 4 Drawing Sheets

GAME SYSTEM AND GAME METHOD

BACKGROUND OF THE INVENTION

1. Field of Invention

The present invention relates to a game system and method in which a game is played by detecting a specified location on the screen specified by a player.

2. Description of Related Art

There is generally know a shooting game system.

In such a shooting game system, a player shoots a target displayed on a screen through a gun-like device.

In such a case, for example, the game system may be designed so that light illumination means previously incorporated into the gun-like device is to detect an illuminated position to judge whether the target is hit.

SUMMARY OF THE INVENTION

An objective of the present invention is to provide a game system and method which can improve the stage effect of a game by changing a image structure based on the position irradiated and detected by the light illumination means.

(1) The present invention provides a game system that comprises means which sets a given specified area based on a position specified on a screen by a player using specifying means; and image effect means which displays an image with a game effect in which the specified area is displayed in a manner relatively differing from an area other than the specified area.

The present invention further provides a game method that comprises a step of setting a given specified area based on a position specified on a screen by a player using specifying means; and image effect step of displaying an image with a game effect in which the specified area is displayed in a manner relatively differing from an area other than the specified area.

According to the present invention, the player can enjoy the game with an improved game effect while distinguishing the specified area from the other area than the specified area by setting a given specified area based on a position specified by the player using the specifying means and displaying an image with a game effect in which the specified area is to displayed in a manner differing from the other area than the specified area.

In this case, the specifying means may be any of various forms such as to specify a specified position by illuminating and imaging it from the side of the player or to specify a specified position on the player side to receive the light from the screen.

(2) The game system of the present invention may comprise position detection means which detects the specified position on the screen specified by the player.

The game method of the present invention may comprise a position detection step of detecting the specified position on the screen specified by the player.

(3) The present invention still further provides a game system that comprises a gun-like device including a simulated searchlight and specifying a specified position on a screen using specifying means; position detection means which detects the specified position; means which sets a given specified area as an area illuminated by the simulated searchlight based on the specified position detected by the position detection means; and image effect means which displays an image with a game effect in which the specified area is displayed in a manner relatively differing from an area other than the specified area.

The present invention yet still further provides a game method that comprises a step of specifying a specified position on a screen using specifying means of a gun-like device including a simulated searchlight; a position detection step of detecting the specified position; a step of setting a given specified area as an area illuminated by the simulated searchlight based on the specified position detected in the position detection step; and a step of displaying an image with a game effect in which the specified area is displayed in a manner relatively differing from an area other than the specified area.

In such an arrangement, the player can enjoy a more realistic game in which the specified area on the screen is illuminated by the simulated searchlight installed to the gun-like device while the sight of the gun-like device is set in the illuminated specified area.

(4) In the game system of the present invention, the specifying means may include light illumination means, and the position detection means may detect a position of the spotlight projected onto the screen by the light illumination means, based on an imaging signal from an imaging means, which images the screen or a spotlight forming area onto which a spotlight passed through or reflected by the screen is projected.

In the game method of the present invention, the specifying means may include light illumination means, and the position detection step may include detecting a position of the spotlight projected onto the screen by the light illumination means, based on an imaging signal from an imaging means, which images the screen or a spotlight forming area onto which a spotlight passed through or reflected by the screen is projected.

(5) In the game system of the present invention, the specifying means may include a light detection section which receives the light from the screen, and the position detection means may detect the specified position based on a timing at which the light detection section receives the light and on the data of image scanning position.

In the game method of the present invention, the specifying means may include a light detection section which receives the light from the screen, and the position detection step may include detecting the specified position based on a timing at which the light detection section receives the light and on the data of image scanning position.

In such an arrangement, the specified position on the screen specified by the player using the specifying means can surely be detected and reflected in the game.

In this case, the screen may be any of various forms such as CRT or a screen onto which a projected image is projected.

(6) In the game system of the present invention, the image effect means may display an image with a game effect in which visibility of the specified area is higher while visibility of an area other than the specified area is lower than visibility of the specified area.

In the image effect step in the game method of the present invention, an image is displayed with a game effect in which visibility of the specified area is higher while visibility of an area other than the specified area is lower than visibility of the specified area.

Such an arrangement may realize an effect in which an image of the specified area will be distinguished so that the player can enjoy the game.

(7) In the game system of the present invention, the image effect means may display an image with a game effect in which luminance of the specified area is higher while luminance of an area other than the specified area is lower than luminance of the specified area.

In the image effect step in the game method of the present invention, an image may be displayed with a game effect in which luminance of the specified area is higher while luminance of an area other than the specified area is lower than luminance of the specified area.

Such an arrangement may improve the game effect by executing a game effect in which a player can search a target by illuminating a target that moves in the dark using a searchlight to illuminate it.

(8) The game system of the present invention may include specified area changing means which changes at least one of a size and shape of the specified area.

The game method of the present invention may include a specified area changing step of changing at least one of a size and shape of the specified area.

In such an arrangement, the player can enjoy a game by changing the size and/or shape of the specified area to make the specified area more suitable for the game.

(9) In the game system of the present invention, the specifying means may be formed to specify a direction of sight of the gun-like device, and a shooting game may be performed by specifying a specified position on the screen as a sight of the gun-like device and aiming at a target displayed on the screen by the gun-like device.

In the game method of the present invention, the specifying means may be formed to specify a direction of sight of the gun-like device, and a shooting game may be performed by specifying a specified position on the screen as a sight of the gun-like device and aiming at a target displayed on the screen by the gun-like device.

(10) The game system of the present invention may comprise simulated illumination means which illuminates the specified area on the screen in a simulated manner, the specifying means may specify a simulated illuminating direction of the simulated illumination means, and the game system may be capable of executing an exploration game in which an object on the screen is sought by specifying the specified position on the screen in a direction of simulated illumination using the simulated illumination means.

The game method of the present invention may comprise simulated illumination means which illuminates the specified area on the screen in a simulated manner, the specifying means may specifying a simulated illuminating direction of the simulated illumination means, and the game system may be capable of executing an exploration game in which an object on the screen is sought by specifying the specified position on the screen in a direction of simulated illumination using the simulated illumination means.

In such an arrangement, for example, the player can enjoy a game that provides a tense feeling to the player as if he or she is seeking a thing in a dark jungle using a lighting device.

However, the present invention is not limited to a game of shooting in the dark or seeking in the dark jungle. For example, the present invention can provide such a game system that provides the tense feeling to the player, such as a game in which a camera is used to focus on a target and the focused target is distinguished, or a game in which a periscope is used to observe a specified location.

The present invention further provides a program stored in a carrier wave or information storage medium and for realizing the above-described means. The present invention further provides an information storage medium for storing a program used to execute the above-described means.

The program for executing the above-described means may be stored in a single information storage medium or in a plurality of information storage media.

DETAILED DESCRIPTION OF PREFERRED EMBODIMENTS

Embodiments of the present invention will now be described in detail with reference to the drawings.

Figure 1:
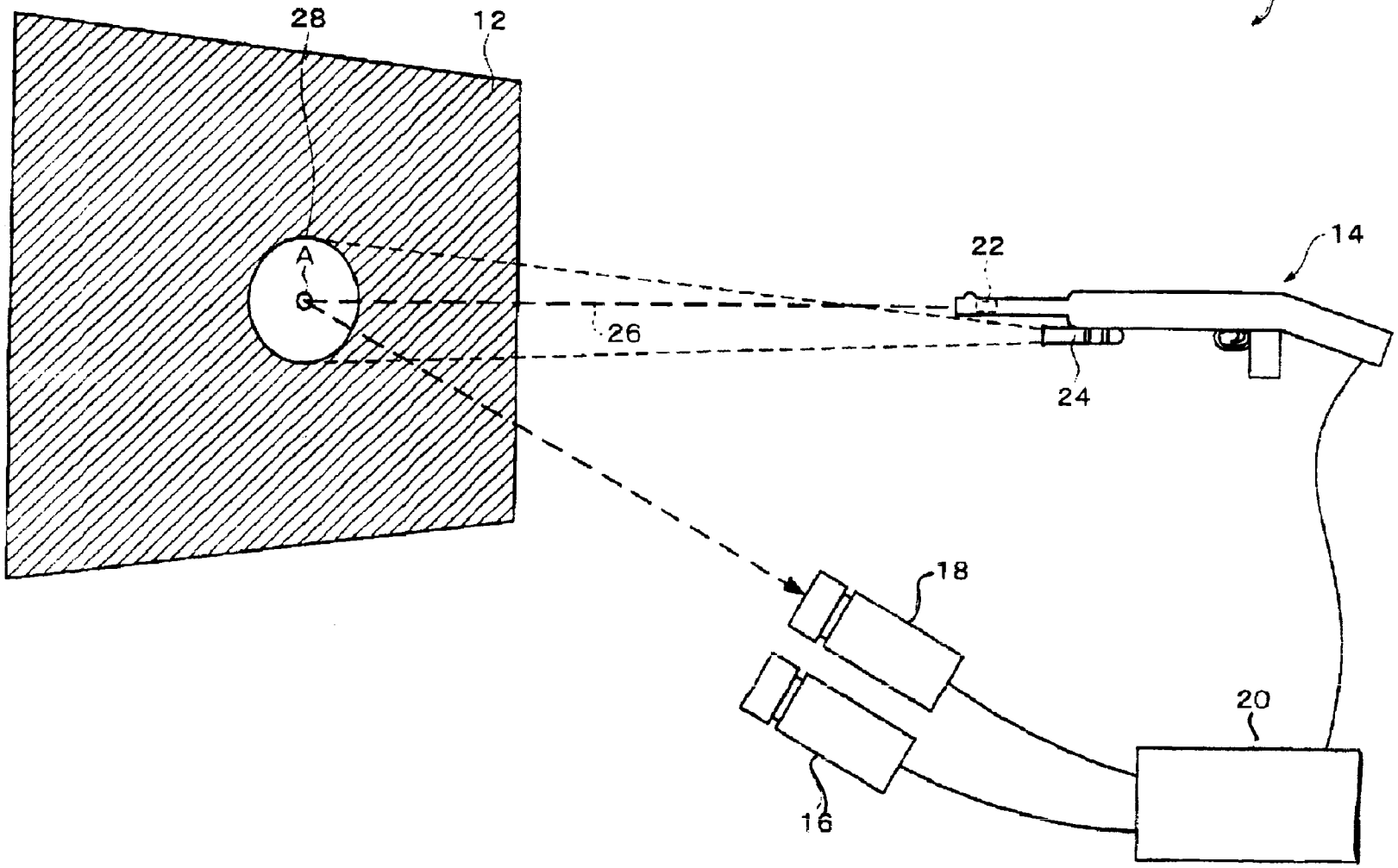
FIG. 1 is a schematic view illustrating the structure of a game system according to one embodiment of the present invention.

FIG. 1 is a schematic view illustrating the structure of a game system to which one embodiment of the present invention is applied.

Referring to FIG. 1, the game system 10 is for executing a shooting game and comprises a screen 12, a gun-like device 14, a projector 16 for projecting a shooting game image, a camera 18 and a main game device 20.

The screen 12 has its dimensions corresponding to those of the screen onto which the shooting game image is projected by the projector 16. The shooting game image includes target images, background images, hitting images and so on.

The gun-like device 14 is connected to the main game device 20 and controlled by the main game device 20.

The gun-like device 14 is simulated into a rifle which includes a simulated searchlight 24 mounted on the outside thereof and an infrared light emitting section 22 mounted in the gun-like device 14 as specifying means and light illumination means. Thus, the infrared light is emitted from the infrared light emitting section 22 in the direction in which the sight of the gun-like device 14 is set. As the muzzle of the gun-like device 14 is directed toward the screen 12, the infrared light will be projected onto the screen 12.

When a player sets the sight of the gun-like device 14 on a target image displayed on the screen 12, the infrared light 26 emitted from the infrared light emitting section 22 in the gun-like device 14 is projected onto the screen 12 to form a spotlight A thereon at the illuminated position.

In this embodiment, the infrared light emitting section 22 uses an infrared ray LED.

When the trigger of the gun-like device 14 is pulled, a trigger signal is sent to the main gun system body 20.

The simulated searchlight 24 will not actually emit an illuminating light. On the screen, there is displayed an image in which a specified area 28 around the spotlight or sighted position A is increased in luminance while the area than the specified area is decreased in luminance. Therefore, the screen will display the image as if the specified area 28 is illuminated by the simulated searchlight 24.

The camera 18 functions as imaging means which images the infrared light image on the screen 12 and for outputting the corresponding image signal.

In this embodiment, the camera 18 may be set to capture images with a time interval equal to 1/60 seconds.

The main game device 20 controls the respective sections in the game system 10 and to perform a given processing.

Figure 2:
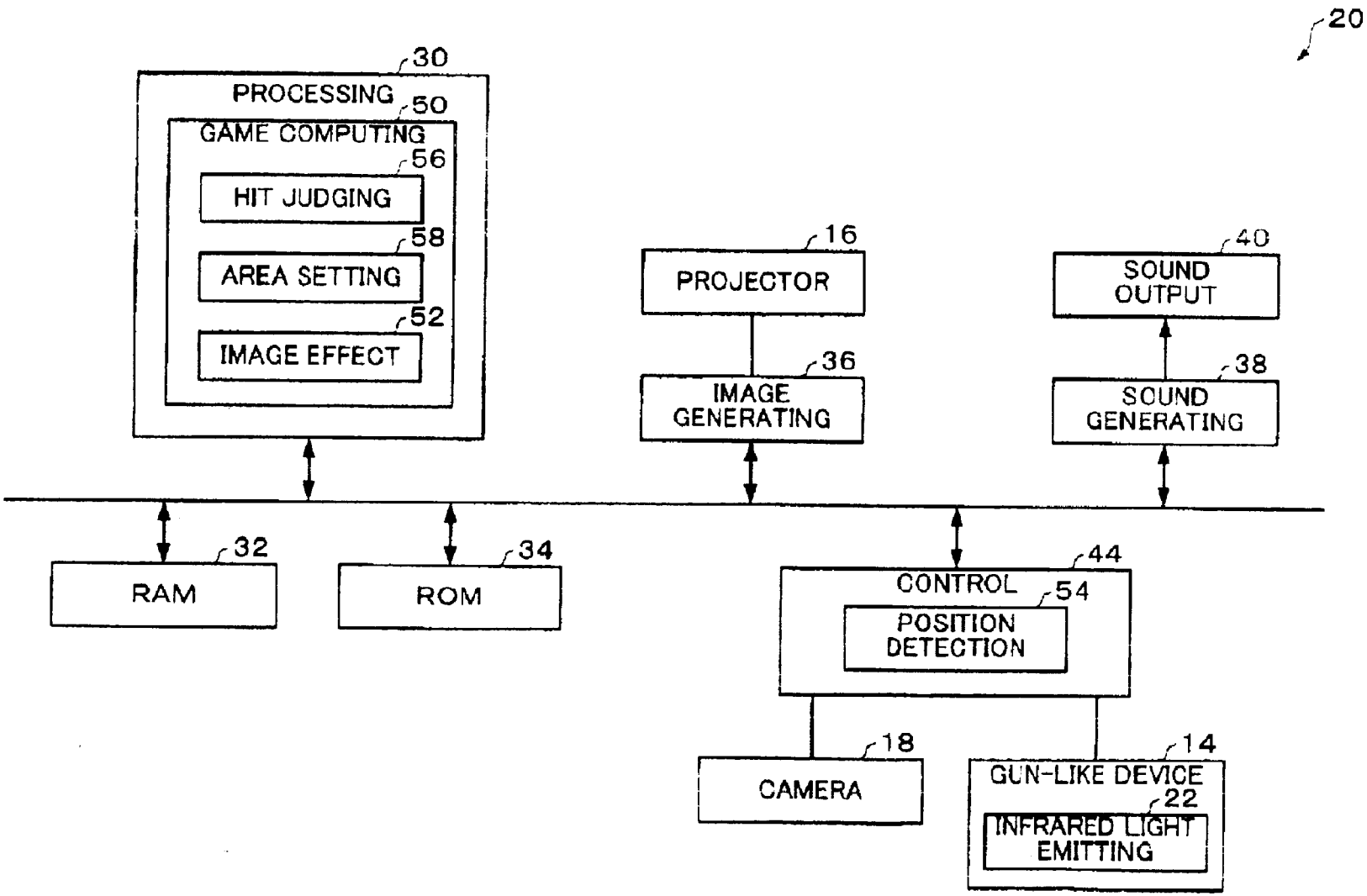
FIG. 2 is a functional block diagram illustrating a main game device.

FIG. 2 is a functional block diagram illustrating the arrangement of the main game device 20.

Referring to FIG. 2, the main game device 20 comprises a processing section 30, a RAM 32, a ROM 34, an image generating section 36, a sound generating section 38, a sound output section 40 and a control section 44.

The processing section 30 is to perform various processings such as control of the entire system, instruction to the respective blocks in the system, game computation and so on. The function of the processing section 30 may be realized by any suitable hardware means such as CPU (CISC or RISC type), DSP, ASIC (gate array) or the like or through a given program (or game program).

The RAM 32 provides a working area for the processing section 30, image generating section 36, sound generating section 38 and others.

The ROM 34 is to store information including the program and data and may be computer readable.

In this embodiment, the ROM 34 has stored information for executing a shooting game by illuminating the infrared light 26 toward the screen 12 and projecting the spotlight A onto a sighted position on the screen 12 through the gun-like device 14.

The information stored in the ROM 34 may include shooting game image data, shooting game sound data, shooting game execution program, directing program and so on.

The processing section 30 will perform various processings based on the information of program and data stored in this ROM 34.

The image generating section 36 receives instructions from the processing section 30 to generate various images and to output them toward the screen 12. The function thereof may be realized by any suitable hardware means such as image generation ASIC, CPU, DSP or the like or through a given program (or image generating program) and image data.

The image generated by the image generating section 36 is outputted through the projector 16.

The sound generating section 38 receives instructions from the processing section 30 to generate various sounds and to output them toward the sound output section 40. The function thereof may be realized by any suitable hardware means such as sound generation ASIC, CPU, DSP or the like or through a given program (or sound generating program) and sound data (waveform data or the like).

The sound generated by the sound generating section 38 is outputted through the sound output section 40.

The control section 44 controls the camera 18 and gun-like device 14 and delivers information between the camera 18 and the gun-like device 14. The control section 44 also functions as a position detection section 54. The function of the control section 44 may be realized, for example, by CPU, ROM or RAM or through a given program and data.

The position detection section 54 detects the position of the spotlight A formed by the infrared light 26 from the infrared light emitting section 22 in the gun-like device 14, based on the image signal from the camera 18.

In this embodiment, the position of the spotlight A is detected according to an X-Y coordinate system including a horizontal X-axis, a vertical Y-axis and an origin (0, 0) which is located on the screen 12 at its leftward and upper corner in FIG. 1.

The detection of the spotlight position is carried out in synchronous with the captures at 1/60 second intervals.

The processing section 30 comprises a game computing section 50.

The game computing section 50 is to process various game computations such as the reception of coin (or charge), the setting of game mode, the progress of game, the synchronization of image, the motion of target or character image, the stage direction, the display of letters, the computation of game results (game scores or points) or the game over, based on the image signals from the camera 18, the signals from the gun-like device 14, the game program stored in an information storage medium 34 and so on.

The game computing section 50 also functions as an area setting section 58, an image effect section 52 and a hit judging section 56.

The area setting section 58 sets a given specified area 28 based on the position of the spotlight A detected by the position detection section 54 (or specified position).

In this embodiment, this specified area 28 is simulated into an illuminating ray from the simulated searchlight 24 and constructed of a circular area located around the position of the spotlight A and having a given size.

The specified area 28 may be changed relating to at least one of the size and shape thereof, using any suitable specified area changing means (not shown).

For example, the specified area changing means may comprise means which slidably moves a lever or slide member located on the outer periphery of the simulated searchlight 24 and means which detects the amount of slidable movement. When the detection means detects the amount of slidable movement in the lever or slide member, the size or shape of the specified area 28 may be changed depending on the detected amount of movement. Thus, the game can be enjoyed while changing the size and/or shape of the specified area 28.

In this case, the luminance may be changed in addition to the changing of the specified area.

For example, the luminance may be increased if the specified area is reduced in size or vise versa.

In such a manner, the representation may be made as if the rate of light convergence is changed depending on the size of the illuminated area. This provides a more realistic picture to the player.

The image effect section 52 is to display an image such that the specified area 28 will be displayed in a manner differing from that of the other area than the specified area 28.

In this embodiment, the game image is displayed such that the luminance of the specified area 28 is higher while the luminance of the other area than the specified area 28 is lower.

In such a configuration, the player can have a feeling as if he or she is performing a firefight in which a target is sought and shot in the dark while illuminating the simulated searchlight 24. This can provide a tense feel to the player.

The hit judging section 56 receives a trigger signal from the gun-like device 14 and judges a hitting by collating the coordinates (X, Y) of the spotlight A inputted from the position detection section 54 with the display coordinate area of a target image synthesized and computed.

If it is judged that the coordinates (X, Y) of the spotlight is contained within the area displaying the target image, it is determined that the spotlight A hits against the target.

The game computing section 50 computes and executes a given game effect based on the result of hit judgment.

More particularly, if the spotlight A is out of the target, the image generating section 36 and projector 16 form and project an impact image on a location other than the target.

On the other hand, if the spotlight A hits against the target, the image generating section 36 and projector 16 form and project an impact image on the target.

The game computing section 50 also computes the result of game based on the result of hit judgment for the spotlight A.

Figure 3:
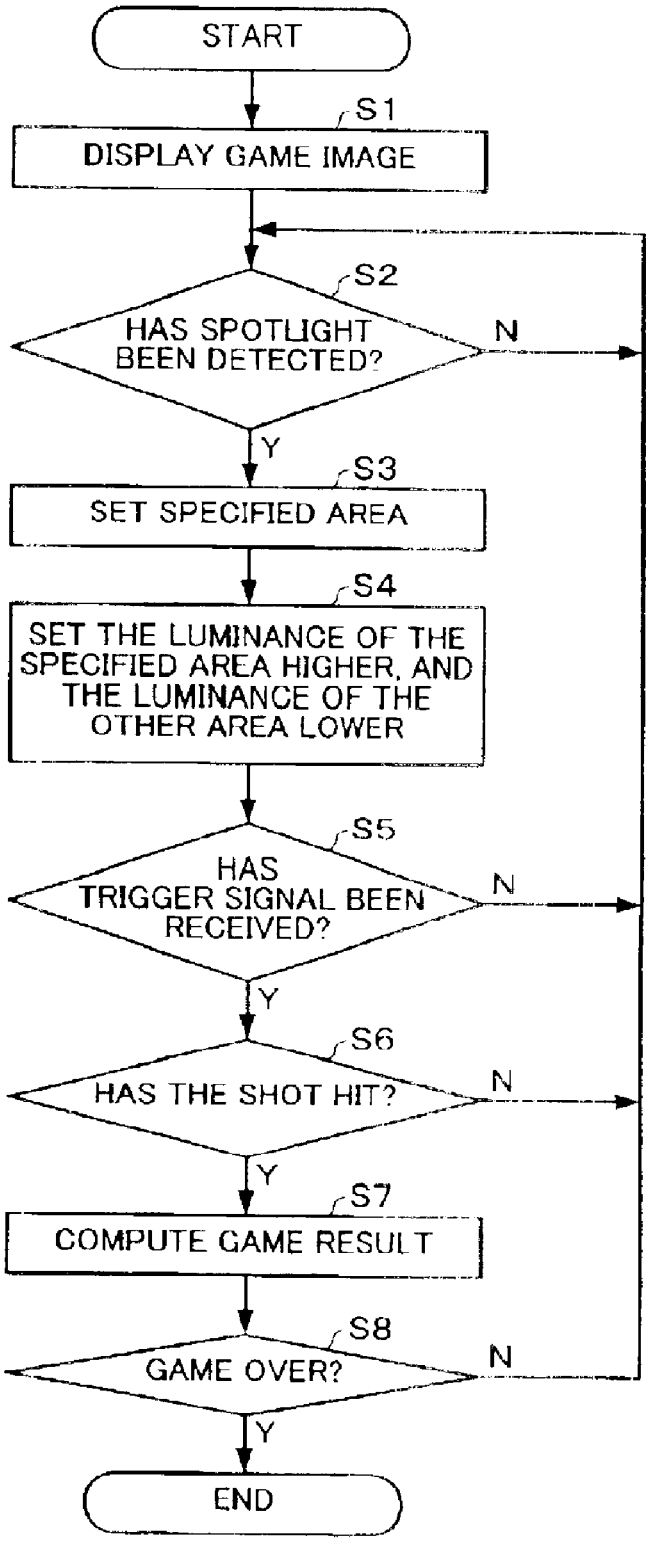
FIG. 3 shows a flowchart illustrating the operation of the game system according to this embodiment.

FIG. 3 shows a flowchart illustrating the operation of this game system 10.

As the game system is started, the projector 16 first projects a game image onto the screen 12 (S1).

In such a state, a player will initiate the shooting game while holding the gun-like device 14.

As the game is started, the infrared light 26 is emitted from the infrared light emitting section 22 in the gun-like device 14.

As the gun-like device 14 is directed toward the screen 12 by the player, the infrared light 26 is projected onto the screen 12 to form a spotlight A at the sighted position.

At this time, the camera 18 images the infrared light image on the screen 12 to detect the spotlight A thereon (S2).

If the spotlight A is not detected, the detection of the spotlight A will be repeated.

If the spotlight A is detected, the area setting section 58 sets a specified area 28 within a given range around the spotlight A (S3).

Next, if the specified area 28 has been set by the area setting section 58, the image effect section 52 displays the game image such that the luminance of the specified area 28 is higher while the luminance of the other area than the specified area 28 is lower (S4).

In such a case, the other area other than the specified area 28 may be displayed to be dully dark or not to be entirely displayed.

As the player moves the sight of the gun-like device 14 to seek the target on the screen in such a situation, the specified area 28 having its higher luminance will be moved on the screen.

In such a manner, the player can enjoy the tense game as if he or she seeks the target while illuminating the dark by the searchlight 24 on the gun-like device 14.

As the player finds the target and pulls the trigger, the gun-like device 14 emits and sends a trigger signal to the main game device 20.

The main game device 20 monitors the output of the trigger signal (S5) and continues to monitor the spotlight A if the main game device 20 receives no trigger signal (S2).

When the main game device 20 receives the trigger signal, the hit judging section 56 collates the position of the spotlight A that is a sighted position on reception of the trigger signal with the position of the target to judge whether or not the shot hits the target (S6).

If not so, the procedure again returns to the monitoring of the spotlight A (S2).

If the shot hits the target, the result of game is computed and recorded (S7).

It is then judged whether or not the game is over (S8). If not so, the procedure again returns to the monitoring of the spotlight A (S2). If the game is over, the game is terminated.

Figure 4:
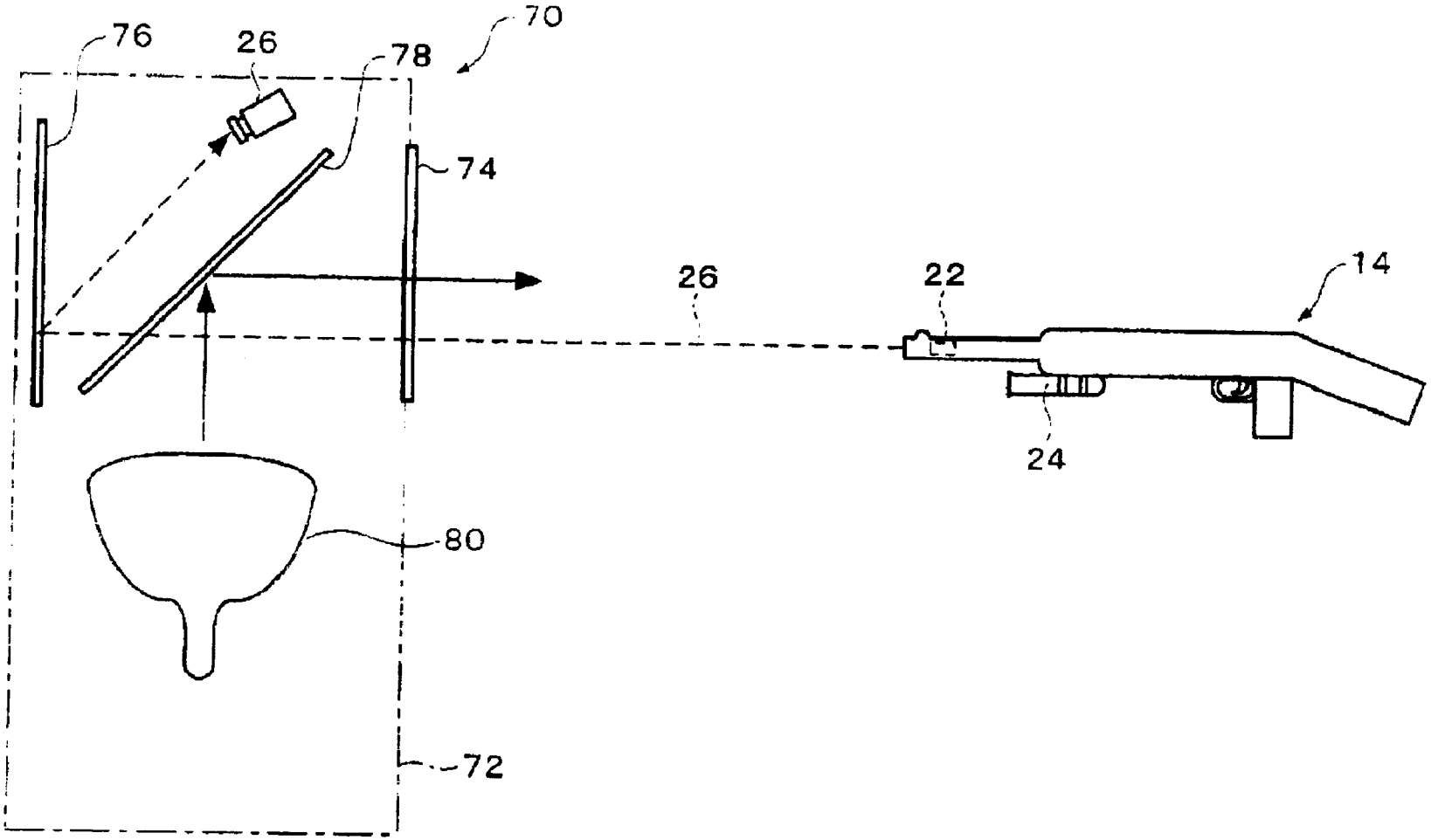
FIG. 4 is a schematic view illustrating the structure of a game system according to another embodiment of the present invention.

FIG. 4 is a schematic view illustrating another game system according to the present invention.

In FIG. 4, parts similar to those of the previous embodiment are denoted by similar reference numerals, but will not further described.

The game system comprises a main game device 70 which comprises a housing 72, a display 74 on the housing at one side facing the gun-like device 14, a spotlight forming area 76 formed in the interior of the housing 72 at a position corresponding to the display 74, a half mirror 78 disposed between the spotlight forming area 76 and the display 74, a CRT 80 disposed below the half mirror 78 with the top thereof being directed upward, and a camera 18 for imaging the spotlight forming area 76.

The main game device includes a circuit board (not shown) incorporated thereinto so that the functions similar to those shown by the blocks of FIG. 2 will be realized.

The display 74 is formed of a transparent material such as glass or plastic sheet such that the picture displayed on the display 74 can externally be viewed through the half mirror 78.

The half mirror 78 transmits a part of the incident light but reflects the other part, thus functioning as a separation means.

The half mirror 78 is positioned with a given angle (e.g., 45 degrees) relative to the gun-like device 14.

The spotlight forming area 76 is located behind the half mirror 78 to receive the part of the incident light passed from the gun-like device 14 through the half mirror 78. The CRT 80 is located at a position wherein it receives the incident light incoming from the gun-like device and reflected by the half mirror 78.

Thus, the picture on the CRT 80 may be reflected toward the player by the half mirror 78. The player holding the gun-like device 14 with hand can view the image.

The infrared light 26 emitted from the gun-like device 14 passes through the half mirror 78 to form a spotlight on the spotlight forming area 76.

The function of the camera 40 is similar to that of the previously described embodiment and adapted to perform the detection of impact position for the spot light and the judgment of hitting based on the image data taken by the camera 40. In this connection, the positional relationship between the spotlight forming area 76 and CRT 80 relative to the half mirror 78 may be reversed.

The present invention is not limited to the aforementioned embodiments, but may be carried out in any of various other forms without departing from the spirit and scope of the invention.

Although the embodiments have been described as to the shooting game system, the present invention may similarly be applied to any of various other game systems such as a game of seeking an object while viewing the lens of a camera, a game of viewing the surface of the sea through a periscope or a game of exploring a jungle while illuminating a light.

For example, in the game of exploring a jungle while illuminating a light, a game image for jungle exploration may be displayed on the screen or display as in the previous embodiments. When a player directs a simulated light toward the game image, an infrared light projecting section incorporated into the simulated light emits the infrared light to form a spotlight on the screen or spotlight forming area. A specified area can be set by imaging the spotlight through the camera to detect a specified position.

Although the previous embodiments have been described as the case where the luminance of the other area than the specified area is lower to provide a dully dark state or a state of not entirely display the other area, the present invention may be applied to any other display wherein the other area than the specified area is gradated or flared to provide a reduced visibility.

On the contrary, the luminance or visibility of the specified area may be reduced while the luminance or visibility of the other area than the specified area may be increased.

Although the previous embodiments have been described as to the continuous illumination of the infrared sighting ray from the infrared light projecting means during the game play, the present invention may be carried out to emit the infrared light only when the trigger is pulled.

Although the previous embodiments have been described as to the detection of the spotlight by imaging the infrared light image through the camera, the present invention may be carried out to detect the light on the CRT or image projecting screen through the light detection section as the specifying means and to detect the specified position based on the timing at which the light detection section receives the light and the image scanning position data at this time.

What is claimed is:

1. A game system, comprising:

specifying means for specifying a specified position on a screen by a player;

means for setting a specified area based on the specified position; and image effect means for displaying an image with a game effect in which visibility of an area other than the specified area is lower than visibility of the specified area.

2. The game system according to claim 1, wherein the image effect means displays the image with a game effect in which luminance of an area other than the specified area is lower than luminance of the specified area.

3. The game system according to claim 1, further comprising position detection means for detecting the specified position.

4. The game system according to claim 3, further comprising imaging means for imaging the screen to generate imaging signals, wherein the specifying means includes light illumination means for projecting a spotlight from the specifying means to the specified position, and wherein the position detection means detects the specified position by detecting a position of the spotlight projected onto the screen based on the imaging signals.

5. The game system according to claim 3, wherein the specifying means includes a light detection section that receives light from the screen, and wherein the position detection means detects the specified position based on a timing at which the light detection section receives the light and on data of image scanning position.

6. The game system according to claim 1, further comprising specified area changing means for changing at least one of a size and shape of the specified area.

7. The game system according to claim 1, wherein the specifying means includes a shooting device, the specifying means usable for specifying a direction of sight of the shooting device, and wherein the player performs a shooting game by aiming the shooting device at a target displayed on the screen, thereby specifying the specified position on the screen.

8. The game system according to claim 1, further comprising simulated illumination means for simulating an effect of illuminating the specified area on the screen, wherein the specifying means specifies a simulated illuminating direction of the simulated illumination means, and wherein the game system is capable of executing an exploration game in which an object on the screen is sought by specifying the specified position on the screen in the simulated illuminating direction of the simulated illumination means.

9. A game system, comprising:

a shooting device including a simulated searchlight and specifying means for specifying a specified position on a screen;

position detection means for detecting the specified position;

means for setting a specified area as an area illuminated by the simulated searchlight based on the specified position detected by the position detection means; and image effect means for displaying an image with a game effect in which visibility of an area other than the specified area is lower than visibility of the specified area.

10. The game system according to claim 9, wherein the image effect means displays the image with a game effect in which luminance of an area other than the specified area is lower than luminance of the specified area.

11. The game system according to claim 9, further comprising imaging means for imaging the screen and generating imaging signals, wherein the specifying means includes light illumination means for projecting a spotlight from the specifying means to the specified position, and wherein the position detection means detects the specified position based on the imaging signals.

12. The game system according to claim 9, wherein the specifying means includes a light detection section that receives light from the screen, and wherein the position detection means detects the specified position based on a timing at which the light detection section receives the light and on data of image scanning position.

13. The game system according to claim 9, further comprising specified area changing means for changing at least one of a size and shape of the specified area.

14. The game system according to claim 9, further comprising simulated illumination means for simulating an effect of illuminating the specified area on the screen, wherein the specifying means specifies a simulated illuminating direction of the simulated illumination means, and wherein the game system is capable of executing an exploration game in which an object on the screen is sought by specifying the specified position on the screen in the simulated illuminating direction of the simulated illumination means.

15. A game method, comprising:

specifying a specified position on a screen;

setting a specified area based on the specified position; and displaying an image with a game effect in which visibility of an area other than the specified area is lower than visibility of the specified area.

16. The game method according to claim 15, wherein displaying the image comprises displaying the image with a game effect in which luminance of an area other than the specified area is lower than luminance of the specified area.

17. The game method according to claim 15, further comprising detecting the specified position on the screen.

18. The game method according to claim 17, further comprising imaging the screen to generate imaging signals, wherein the specifying means includes light illumination means for projecting a spotlight from the specifying means to the specified position, and wherein detecting the specified position comprises detecting a position of the spotlight projected onto the screen based on the imaging signals.

19. The game method according to claim 17, further comprising receiving light from the screen, wherein detecting the specified position comprises detecting the specified position based on a timing at which the light detection section receives the light and on data of image scanning position.

20. The game method according to claim 15, further comprising changing at least one of a size and shape of the specified area.

21. The game method according to claim 15, further comprising:

aiming a shooting device at a target displayed on the screen, thereby specifying the specified position on the screen.

22. The game method according to claim 15, further comprising simulating an effect of illuminating the specified area on the screen, wherein specifying the specified position comprises specifying a simulated illuminating direction, the game system method further comprising executing an exploration game in which an object on the screen is sought by specifying the specified position on the screen in the simulated illuminating direction.

23. A game method, comprising:

specifying a specified position on a screen;

detecting the specified position;

setting a specified area as an area illuminated by a simulated searchlight based on the detected specified position; and displaying an image with a game effect in which visibility of an area other than the specified area is lower than visibility of the specified area.

24. The game method according to claim 23, wherein displaying the image comprises displaying the image with a game effect in which luminance of an area other than the specified area is lower than luminance of the specified area.

25. The game method according to claim 23, further comprising imaging the screen to generate imaging signals, wherein the specifying means includes light illumination means for projecting a spotlight from the specifying means to the specified position, and wherein detecting the specified position comprises detecting a position of the spotlight projected onto the screen based on the imaging signals.

26. The game method according to claim 23, further comprising receiving light from the screen, and wherein detecting the specified position comprises detecting the specified position based on a timing at which the light detection section receives the light and on data of image scanning position.

27. The game method according to claim 23, further comprising changing at least one of a size and shape of the specified area.

28. The game method according to claim 23, further comprising simulating an effect of illuminating the specified area on the screen, wherein specifying the specified position comprises specifying a simulated illuminating direction, the game method further comprising executing an exploration game in which an object on the screen is sought by specifying the specified position on the screen in the simulated illuminating direction.

* * * * *